US011178954B2

(12) United States Patent
Zhong

(10) Patent No.: US 11,178,954 B2
(45) Date of Patent: Nov. 23, 2021

(54) DISPENSING-BY-ROTATION LIQUID COSMETIC CONTAINER

(71) Applicant: SHYA HSIN PACKAGING INDUSTRY (CHINA) CO., LTD., Kunshan (CN)

(72) Inventor: Hua Zhong, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 0 days.

(21) Appl. No.: 17/252,736

(22) PCT Filed: Feb. 13, 2019

(86) PCT No.: PCT/CN2019/074890
§ 371 (c)(1),
(2) Date: Dec. 16, 2020

(87) PCT Pub. No.: WO2020/001036
PCT Pub. Date: Jan. 2, 2020

(65) Prior Publication Data

US 2021/0161277 A1 Jun. 3, 2021

(30) Foreign Application Priority Data

Jun. 26, 2018 (CN) ..... 201810670162.4

(51) Int. Cl.
*A45D 34/04* (2006.01)
*A45D 34/00* (2006.01)
(Continued)

(52) U.S. Cl.
CPC ..... *A45D 34/042* (2013.01); *A46B 9/021* (2013.01); *A46B 11/0027* (2013.01);
(Continued)

(58) Field of Classification Search
CPC ..... A46B 9/021; A46B 11/0027; A46B 2200/1046; A46B 11/0031;
(Continued)

(56) References Cited

U.S. PATENT DOCUMENTS 6,227,739 B1 5/2001 Kageyama
2004/0042841 A1* 3/2004 Noguchi ..... A46B 11/0079 401/270

(Continued)

FOREIGN PATENT DOCUMENTS

CN 2753196 Y 1/2006
CN 205658538 U 10/2016

(Continued)

*Primary Examiner* — David J Walczak
(74) *Attorney, Agent, or Firm* — Bayramoglu Law Offices LLC

(57) ABSTRACT

A dispensing-by-rotation liquid cosmetic container includes a pen body, a piston, a threaded rod and a threaded cylinder, which are coaxially arranged. A pen cap is sleeved on the front end of the pen body. A receiving space is provided inside the pen body. A bristle assembly is fixedly arranged at the front end of the receiving space. The pen cap is sleeved on the bristle assembly. The piston is provided in the receiving space. The piston is in an interference fit with the inner wall of the pen body and moves axially along the inner wall of the pen body, and the piston is fixedly connected to the threaded rod. The threaded rod is rotatably connected to the threaded cylinder by an internal thread. The threaded cylinder and the pen body are axially snap-fitted and rotate relative to each other in the circumferential direction.

8 Claims, 13 Drawing Sheets

(51) Int. Cl.
*A46B 11/00* (2006.01)
*A46B 9/02* (2006.01)
*B65D 83/00* (2006.01)

(52) U.S. Cl.
CPC .. *A45D 2034/002* (2013.01); *A45D 2200/055* (2013.01); *A46B 11/0031* (2013.01); *A46B 2200/1046* (2013.01); *B65D 83/0011* (2013.01)

(58) Field of Classification Search
CPC ... A46B 11/0034; A46B 11/00; A46B 11/001; A46B 2200/1053; A45D 34/042; A45D 2034/002; A45D 2200/055; A45D 40/262; A45D 34/00; A45D 2200/054; A45D 40/04; A45D 40/06; B65D 83/005; B65D 83/0011
USPC ..... 401/171–175, 68, 75
See application file for complete search history.

(56) References Cited

U.S. PATENT DOCUMENTS

2007/0086830 A1* 4/2007 Kageyama ..... A45D 34/04 401/172
2007/0248402 A1* 10/2007 Chan ..... A46B 11/0027 401/286

FOREIGN PATENT DOCUMENTS

CN 108577136 A 9/2018
JP 2001232273 A 8/2001

* cited by examiner

DISPENSING-BY-ROTATION LIQUID COSMETIC CONTAINER

CROSS REFERENCE TO THE RELATED APPLICATIONS

This application is the national phase entry of International Application No. PCT/CN2019/074890, filed on Feb. 13, 2019, which is based upon and claims priority to Chinese Patent Application No. 201810670162.4, filed on Jun. 26, 2018, the entire contents of which are incorporated herein by reference.

TECHNICAL FIELD

The present invention relates to a cosmetic container, and more particularly, to a dispensing-by-rotation liquid cosmetic container.

BACKGROUND

Liquid cosmetic pens are widely used among people. In a typical liquid cosmetic pen, cosmetics are typically dispensed by means of squeezing, and the pen body is made of an elastic material. When applying makeup, the pen body is squeezed such that the cosmetic in the pen body flows to the pen tip. However, this type of cosmetic pen may be improperly operated to cause cosmetics to flow out, which not only causes waste of materials, but also readily contaminates other objects. Rotary cosmetic pens have been produced, but the piston of these prior devices rotates along with the tail rod during use. As a result, a gap may be formed between the piston and the pen rod, which easily permits leakage of cosmetic product from the pen.

SUMMARY

In order to overcome the above-mentioned shortcomings, the present invention provides a dispensing-by-rotation liquid cosmetic container. During the use of the cosmetic container, the piston only moves upward in one direction without rotation, thus ensuring a seal between the piston and the pen body.

In order to solve the technical problems, the present invention adopts the following technical solutions.

A dispensing-by-rotation liquid cosmetic container includes a pen body, a piston, a threaded rod and a threaded cylinder, wherein the pen body, the piston, the threaded rod and the threaded cylinder are coaxially arranged. A pen cap is sleeved on the front end of the pen body. A receiving space configured to receive cosmetic liquid is provided inside the pen body. A bristle assembly is fixedly arranged at the front end of the receiving space. The pen cap is sleeved on the bristle assembly. The piston is provided in the receiving space. The piston is in an interference fit with the inner wall of the pen body and moves axially along the inner wall of the pen body. The piston is fixedly connected to the threaded rod. The threaded rod is provided with an external thread. The inner side of the threaded cylinder is provided with an internal thread. The threaded rod is rotatably connected to the threaded cylinder by the internal thread. The threaded cylinder and the pen body are axially snap-fitted and rotate relative to each other in the circumferential direction. A tail cap fixedly connected to the threaded cylinder is sleeved on the outer side of the threaded cylinder.

Preferably, the upper end of the threaded cylinder is a clamping portion, and the lower end of the threaded cylinder is a fixing portion. A plurality of protruding ribs protruding radially outward are provided on the outer side of the fixing portion, and a groove configured to clamp the protruding ribs is provided on the inner side of the tail cap.

Preferably, an internal thread is provided on the inner side of the clamping portion, and at least two elastic pawls are provided on the outer side of the clamping portion. A ratchet protruding radially inward is provided on the inner side of the pen body, and the elastic pawls mesh with the ratchet and rotate in one direction.

Preferably, the clamping portion includes an inner layer and an outer layer. The internal thread is arranged on the inner side of the inner layer, and the elastic pawls are arranged on the outer side of the outer layer. A gap is formed between the inner layer and the outer layer.

Preferably, the head of the threaded rod is polygonal. The piston is provided with a slot. The slot has an opening facing toward the lower end of the piston, and the shape of the slot is complementary to the shape of the head of the threaded rod. The head of the threaded rod is fixedly inserted into the slot.

Preferably, an annular ring protruding radially outward is provided on the outer side of the middle of the threaded cylinder, and an annular groove configured to receive the annular ring is provided on the inner side of the upper end of the tail cap.

Preferably, the bristle assembly includes a bristle base connected to the front end of the cosmetic liquid receiving space, bristles arranged on the bristle base, and a bristle sleeve sleeved on the bristles. A channel connected to the inside of the bristles is provided in the bristle base.

Preferably, the pen body is a hollow structure, and each of the front end and the rear end of the pen body is provided with an opening. The diameter of the front end of the pen body is smaller than the diameter of other parts of the pen body. The pen cap is sleeved on and snap-fitted to the front end of the pen body.

The present invention has the following advantages. In the present invention, the front end of the pen body is fixedly connected to the bristle assembly, the cosmetic liquid is received in the receiving space at the middle part of the pen body, and the piston is provided at the rear end of the receiving space. The bristle assembly, the side wall of the pen body, and the piston form a sealed space for storing the cosmetic liquid. The lower end of the piston is fixedly connected to the threaded rod, and the threaded cylinder is sleeved on the outer side of the threaded rod. The threaded rod and the threaded cylinder are screwed to each other. The upper end of the threaded cylinder and the lower end of the pen body are axially fixed, but can rotate relative to each other. The lower end of the threaded cylinder is fixedly connected to the tail cap. According to the present invention, the cosmetic liquid in the pen body may be extruded onto the bristles by rotating the tail cap with one hand, which is convenient to use and easy to operate. Moreover, by means of the interference fit between the piston and the inner side of the pen body, it is ensured that the cosmetic liquid will not leak without introducing other leak-proof elements. By setting the elastic pawls on the threaded cylinder and setting the ratchet on the pen body, accessories required for the cosmetic container are reduced in number. The elastic pawls and the ratchet mesh with each other and rotate in one direction, which avoids the problem that the cosmetic container cannot dispense the cosmetic liquid smoothly due to a rotation operation in the opposite direction performed by the user. In use, the piston only moves upward in one direction without rotation, thus ensuring the sealing between the piston and the pen body.

Figure 1:
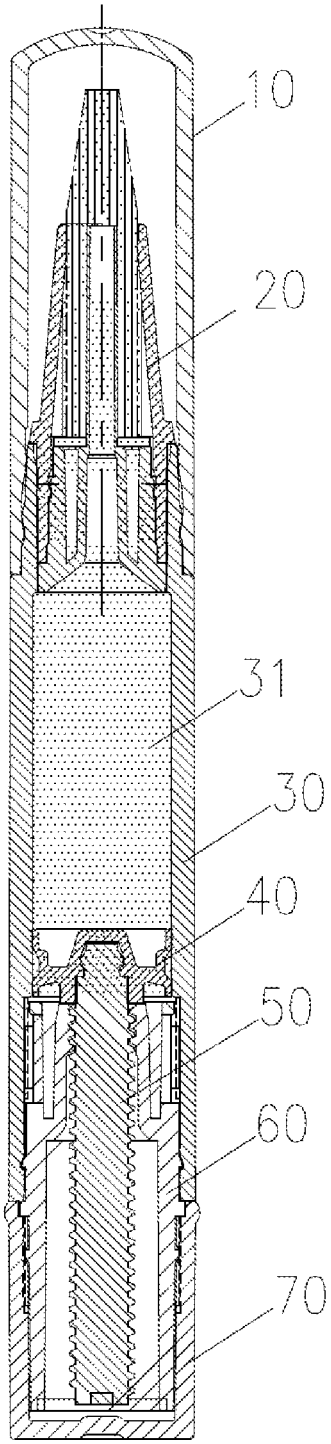
FIG. 1 is a schematic diagram of the structure of the present invention.
Figure 2:
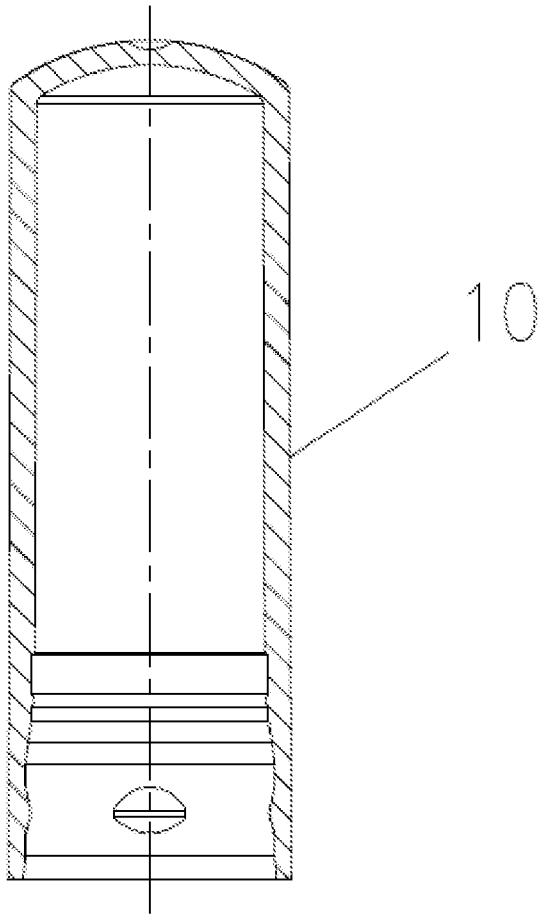
FIG. 2 is a schematic diagram of the structure of the pen cap in the present invention.
Figure 3:
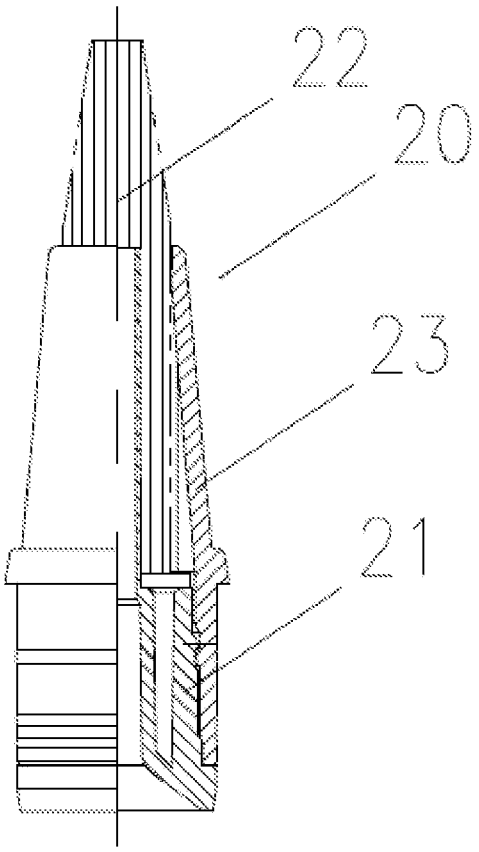
FIG. 3 is a schematic diagram of the structure of the bristle assembly in the present invention.
Figure 4:
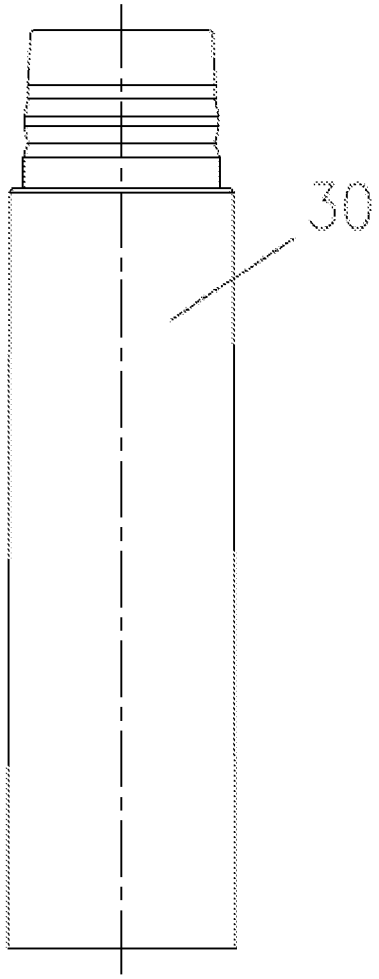
FIG. 4 is a schematic diagram of the structure of the pen body in the present invention.
Figure 5:
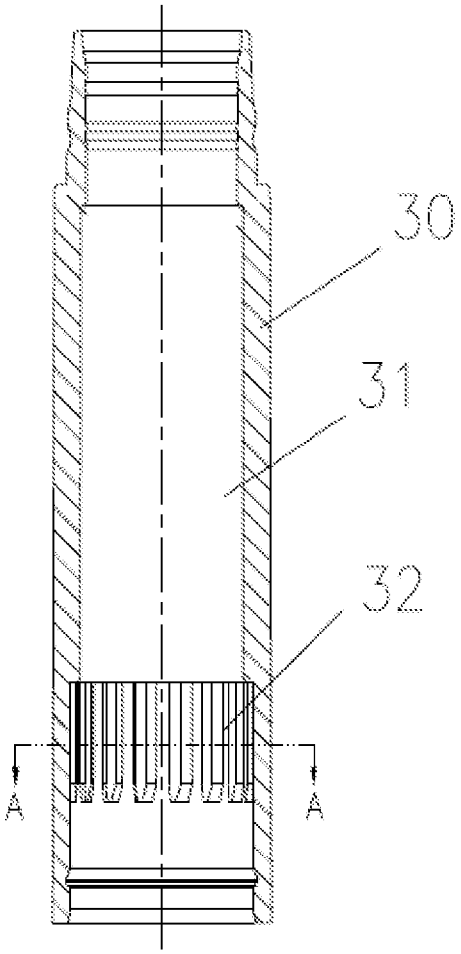
FIG. 5 is a cross-sectional view of the structure of the pen body in the present invention.
Figure 6:
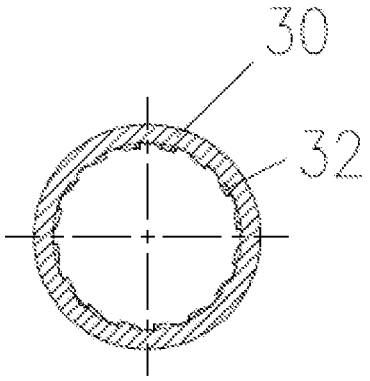
FIG. 6 is a cross-sectional view taken along arrow A-A in FIG. 5.

In the figures: 10-pen cap, 20-bristle assembly, 21-bristle base, 22-bristle, 23-bristle sleeve, 30-pen body, 31-receiving space, 32-ratchet, 40-piston, 41-slot, 50-threaded rod, 51-external thread, 52-head, 60-threaded cylinder, 61-clamping portion, 62-fixing portion, 63-protruding rib, 64-internal thread, 65-elastic pawl, 66-annular ring, 70-tail cap, 71-groove, and 72-annular groove.

DETAILED DESCRIPTION OF THE EMBODIMENTS

The technical solutions in the embodiments of the present invention will be described clearly and completely in combination with the embodiments of the present invention. It is obvious that the described embodiments are only a part of the embodiments of the present invention, rather than all the embodiments of the present invention. Based on the embodiments of the present invention, all other embodiments obtained by those having ordinary skill in the art without creative efforts shall fall within the scope of protection of the present invention.

Embodiment: as shown in FIGS. 1-18, a dispensing-by-rotation liquid cosmetic container includes the pen body 30, the piston 40, the threaded rod 50 and the threaded cylinder 60 which are coaxially arranged. The pen cap 10 is sleeved on the front end of the pen body 30. The receiving space 31 configured to receive cosmetic liquid is provided inside the pen body 30. The bristle assembly 20 is fixedly arranged at the front end of the receiving space 31. The pen cap 10 is sleeved on the bristle assembly 20. The piston 40 is provided in the receiving space. The piston 40 is in an interference fit with the inner wall of the pen body 30 and can move axially along the inner wall of the pen body. The piston 40 is fixedly connected to the threaded rod 50. The threaded rod 50 is provided with the external thread 51. The inner side of the threaded cylinder 60 is provided with the internal thread 64. The threaded rod 50 is rotatably connected to the threaded cylinder 60 by the internal thread. The threaded cylinder 60 and the pen body 30 are axially snap-fitted and can rotate relative to each other in the circumferential direction. The tail cap 70 fixedly connected to the threaded cylinder 60 is sleeved on the outer side of the threaded cylinder 60. The pen body 30 is a hollow structure, and each of the front end and the rear end of the pen body 30 is provided with an opening. The diameter of the front end of the pen body 30 is smaller than the diameter of other parts of the pen body 30. The pen cap 10 is sleeved on and snap-fitted to the front end of the pen body 30. In the present invention, the front end of the pen body 30 is fixedly connected to the bristle assembly 20, the cosmetic liquid is received in the receiving space at the middle part of the pen body 30, and the elastic piston 40 is provided at the rear end of the receiving space. The bristle assembly, the side wall of the pen body, and the piston form a sealed space for storing the cosmetic liquid. The pen cap 10 is sleeved on the bristle assembly 20. The lower end of the piston is fixedly connected to the threaded rod 50, and the threaded cylinder 60 is sleeved on the outer side of the threaded rod. The threaded rod and the threaded cylinder are screwed to each other. The upper end of the threaded cylinder 60 and the lower end of the pen body are axially fixed, but can rotate relative to each other. The lower end of the threaded cylinder 60 protrudes out of the pen body and is fixedly connected to the tail cap 70.

In use, the user removes the pen cap 10 and rotates the tail cap 70 counterclockwise, and then the tail cap drives the threaded cylinder 60 to rotate together. The threaded rod 50 is driven by the threaded cylinder to drive the piston 40 to move toward the front end of the pen body, and the piston extrudes the cosmetic liquid to enable the cosmetic liquid to flow to the bristles for applying makeup. According to the present invention, the cosmetic liquid in the pen body may be extruded onto the bristles by rotating the tail cap with one hand, which is convenient to use and easy to operate. Moreover, by means of the interference fit between the piston and the inner side of the pen body, it is ensured that the cosmetic liquid will not leak without introducing other leak-proof elements.

Figure 7:
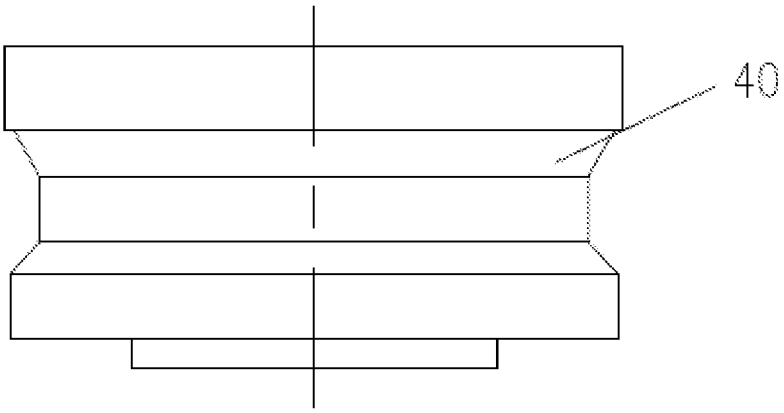
FIG. 7 is a schematic diagram of the structure of the piston in the present invention.
Figure 8:
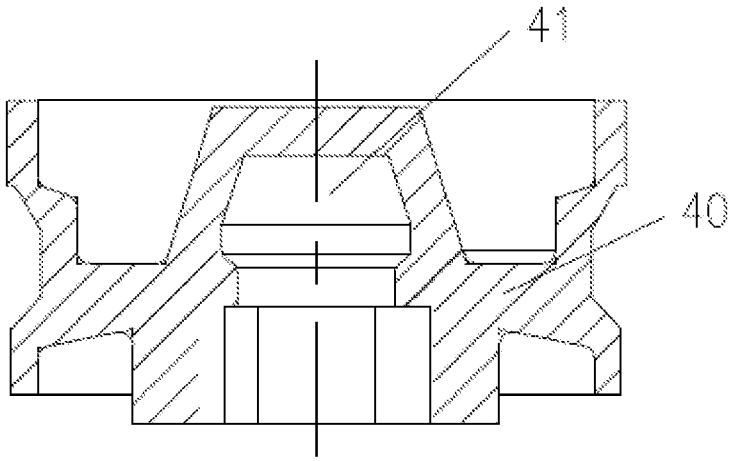
FIG. 8 is a cross-sectional view of the structure of the piston in the present invention.
Figure 9:
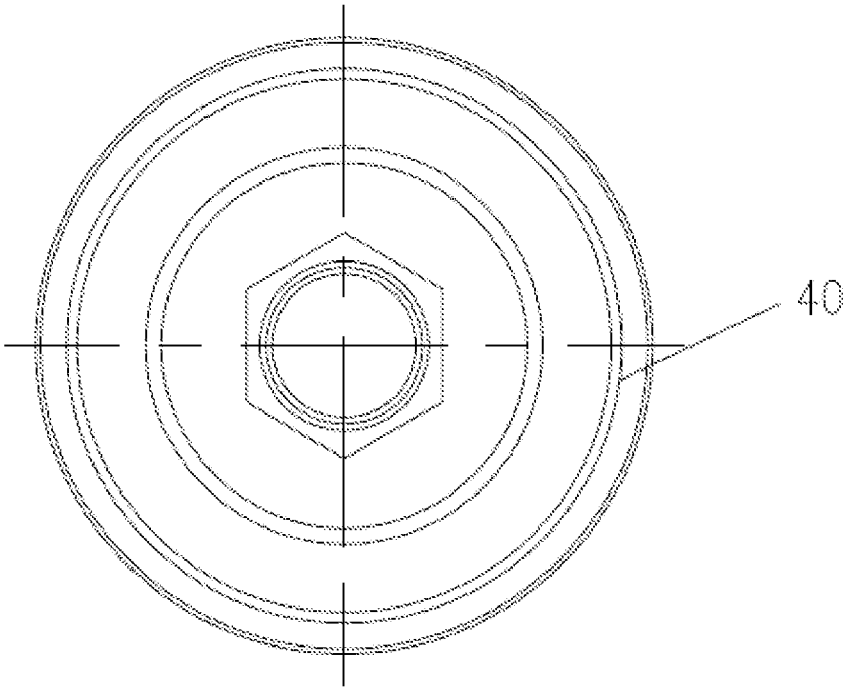
FIG. 9 is a top view of the piston in the present invention.
Figure 10:
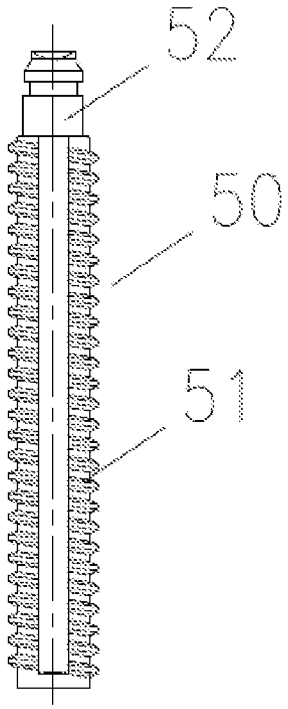
FIG. 10 is a schematic diagram of the structure of the threaded rod in the present invention.
Figure 11:
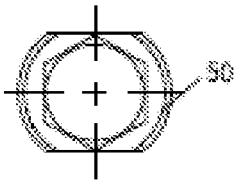
FIG. 11 is a top view of the threaded rod in the present invention.

As shown in FIGS. 7 and 10, the head 52 of the threaded rod is polygonal. The piston 40 is provided with the slot 41, the slot 41 has an opening facing toward the lower end of the piston 40, and the shape of the slot 41 is complementary to the shape of the head of the threaded rod. The head 52 of the threaded rod is fixedly inserted into the slot 41. The bristle assembly 20 includes the bristle base 21 connected to the front end of the cosmetic liquid receiving space, the bristles 22 arranged on the bristle base, and the bristle sleeve 23 sleeved on the bristles. A channel connected to the inside of the bristles is provided in the bristle base 21. The bristles can also be configured as a flocked article or sponge and the like to meet different needs of users.

Figure 12:
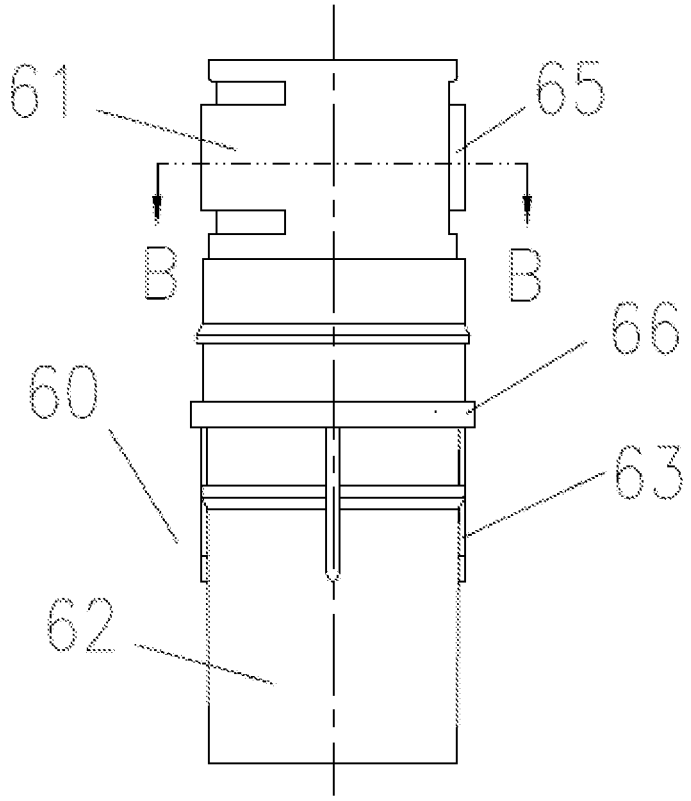
FIG. 12 is a schematic diagram of the structure of the threaded cylinder in the present invention.
Figure 13:
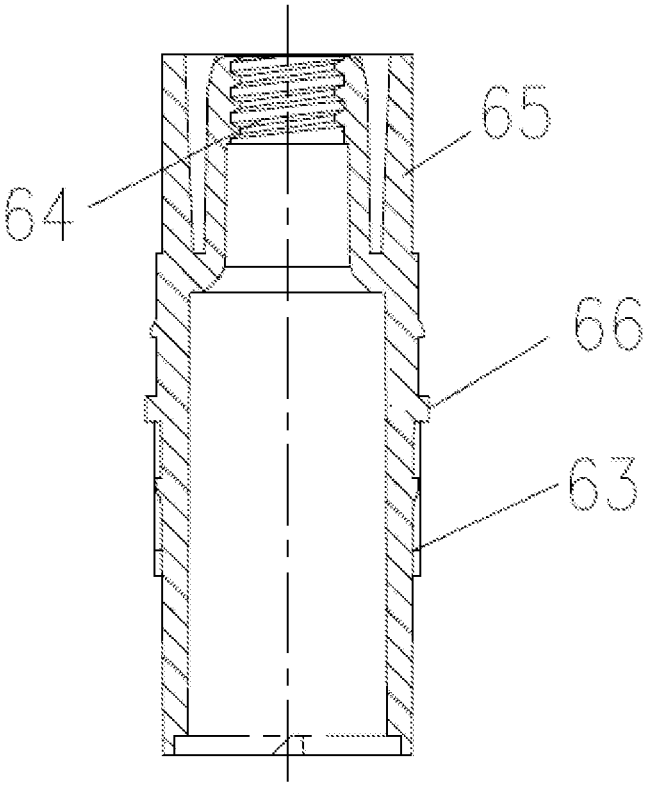
FIG. 13 is a cross-sectional view of the structure of the threaded cylinder in the present invention.
Figure 14:
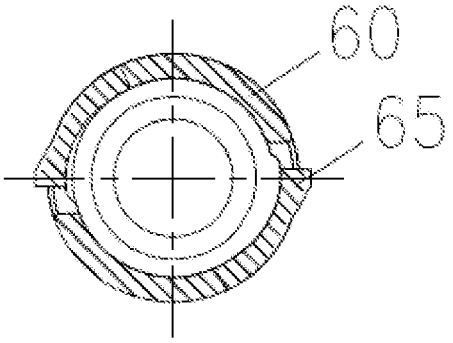
FIG. 14 is a cross-sectional view taken along arrow B-B in FIG. 12.
Figure 15:
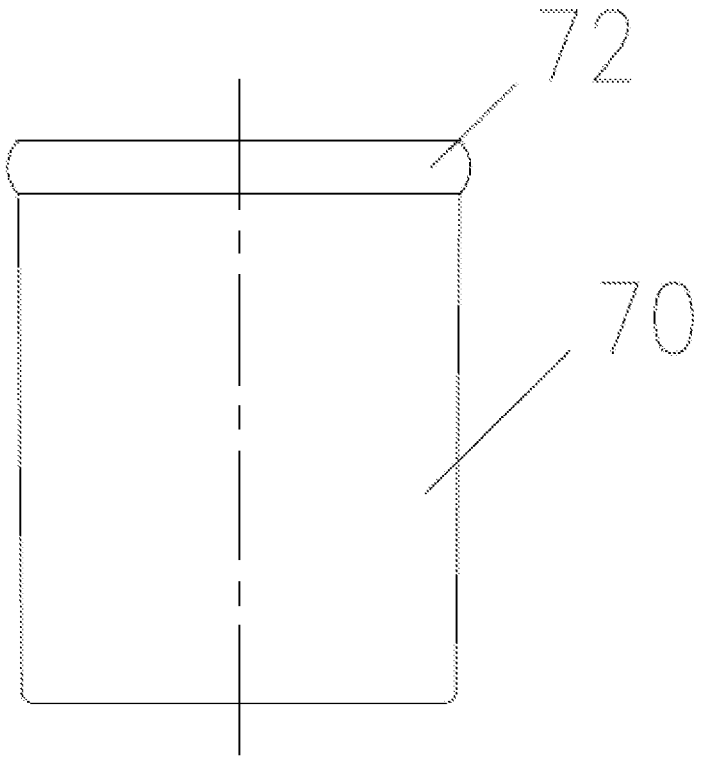
FIG. 15 is a schematic diagram of the structure of the tail cap in the present invention.
Figure 16:
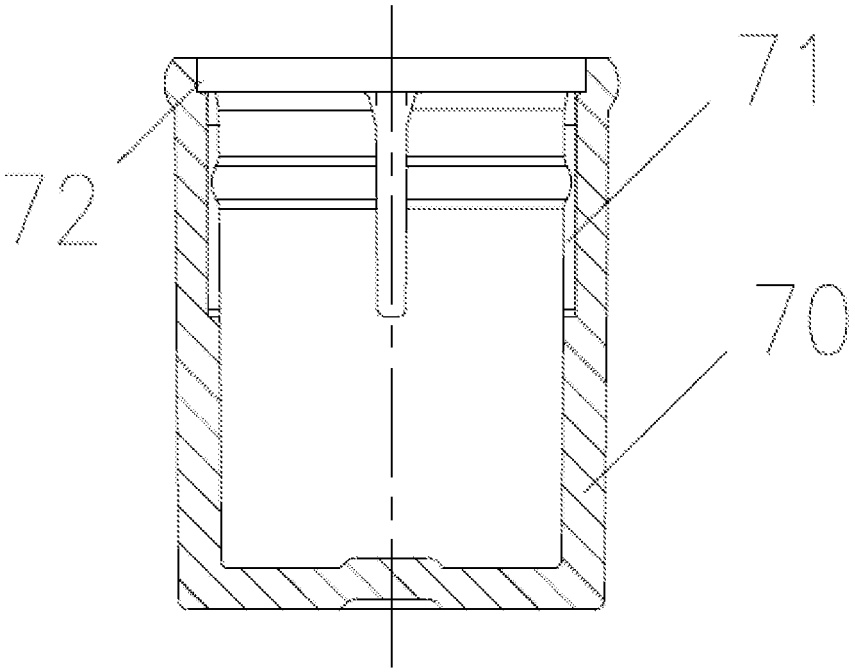
FIG. 16 is a cross-sectional view of the structure of the tail cap in the present invention.

As shown in FIGS. 12-14, the upper end of the threaded cylinder 60 is the clamping portion 61, and the lower end of the threaded cylinder 60 is the fixing portion 62. A plurality of protruding ribs 63 protruding radially outward are provided on the outer side of the fixing portion, and the groove 71 configured to clamp the protruding ribs is provided on the inner side of the tail cap 70. The internal thread 64 is provided on the inner side of the clamping portion 61, and at least two elastic pawls 65 are provided on the outer side of the clamping portion 61. The ratchet 32 protruding radially inward is provided on the inner side of the pen body 30, and the elastic pawls 65 mesh with the ratchet 32 and rotate in one direction. By setting the elastic pawls on the threaded cylinder and setting the ratchet 32 on the pen body, accessories required for the cosmetic container are reduced in number. The elastic pawls 65 and the ratchet 32 mesh with each other and rotate in one direction, which avoids the problem that the cosmetic container cannot dispense the cosmetic liquid smoothly due to a rotation operation in the opposite direction performed by the user. The clamping portion 61 includes an inner layer and an outer layer. The internal thread 64 is arranged on the inner side of the inner layer, and the elastic pawls 65 are arranged on the outer side of the outer layer. A gap is formed between the inner layer and the outer layer. In this way, the elastic deformation of the elastic pawls is enhanced during the rotation of the threaded cylinder 60, so that the threaded cylinder can be rotated and positioned smoothly. The annular ring 66 protruding radially outward is provided on the outer side of the middle of the threaded cylinder 60, and the annular groove 72 configured to receive the annular ring is provided on the inner side of the upper end of the tail cap 70.

Figure 17:
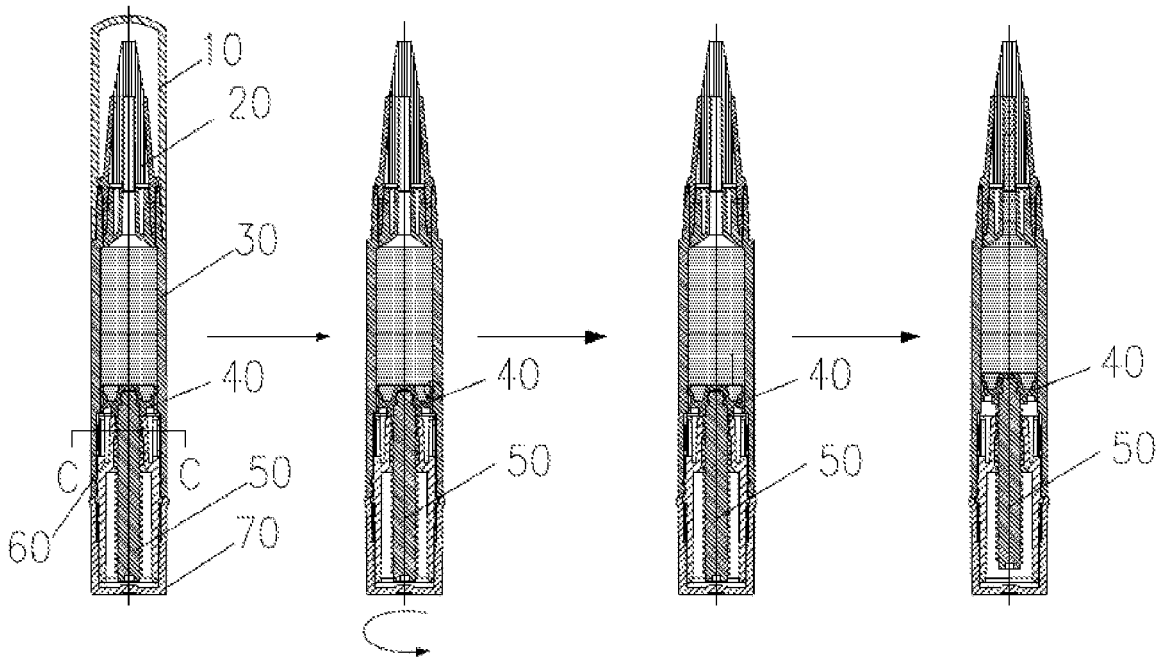
FIG. 17 is a schematic diagram showing the use process of the present invention.
Figure 18:
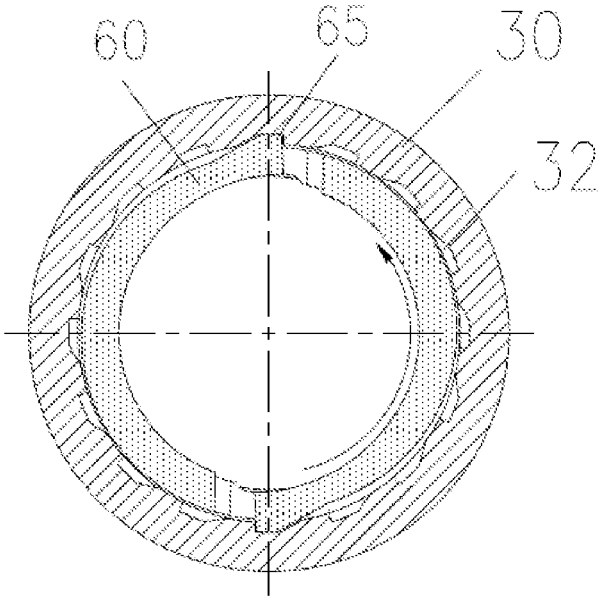
FIG. 18 is a cross-sectional view taken along line C-C in FIG. 17.

The operation process of the present invention is as follows. As shown in FIG. 17, the straight arrow represents the operation sequence, and the curved arrow represents the rotation direction of the tail cap 70 and the threaded cylinder. In use, the user removes the pen cap 10 and rotates the tail cap 70 counterclockwise, and then the tail cap drives the threaded cylinder 60 to rotate together. The threaded rod 50 is driven by the threaded cylinder to drive the piston 40 to move toward the front end of the pen body, and the piston extrudes the cosmetic liquid to enable the cosmetic liquid to flow to the bristles for applying makeup. After the makeup is applied, the pen cap is put back.

It should be pointed out that, for those having ordinary skill in the art, various transformations and improvements can be made without departing from the inventive concept of the present invention, and these transformations and improvements shall fall within the scope of protection of the present invention. Therefore, the scope of protection of the present invention shall be subject to the appended claims.

What is claimed is:

1. A dispensing-by-rotation liquid cosmetic container, comprising a pen body, a piston, a threaded rod and a threaded cylinder, wherein the pen body, the piston, the threaded rod and the threaded cylinder are coaxially arranged;

a pen cap is sleeved on a front end of the pen body; a receiving space configured to receive cosmetic liquid is provided inside the pen body; a bristle assembly is fixedly arranged at a front end of the receiving space; the pen cap is sleeved on the bristle assembly;

the piston is provided in the receiving space; the piston is in an interference fit with an inner wall of the pen body, and the piston moves axially along the inner wall of the pen body; the piston is fixedly connected to the threaded rod;

the threaded rod is provided with an external thread; an inner side of the threaded cylinder is provided with an internal thread; the threaded rod is rotatably connected to the threaded cylinder by the internal thread; and the threaded cylinder and the pen body are axially snap-fitted and rotate relative to each other in a circumferential direction; a tail cap fixedly connected to the threaded cylinder is sleeved on an outer side of the threaded cylinder.

2. The dispensing-by-rotation liquid cosmetic container according to claim 1, wherein an upper end of the threaded cylinder is a clamping portion, and a lower end of the threaded cylinder is a fixing portion; a plurality of protruding ribs protruding radially outward are provided on an outer side of the fixing portion, and a groove configured to clamp the plurality of protruding ribs is provided on an inner side of the tail cap.

3. The dispensing-by-rotation liquid cosmetic container according to claim 2, wherein the internal thread is provided on an inner side of the clamping portion, and at least two elastic pawls are provided on an outer side of the clamping portion; a ratchet protruding radially inward is provided on an inner side of the pen body, and the at least two elastic pawls mesh with the ratchet, and the at least two elastic pawls rotate in one direction.

4. The dispensing-by-rotation liquid cosmetic container according to claim 3, wherein the clamping portion comprises an inner layer and an outer layer; the internal thread is arranged on an inner side of the inner layer, and the at least two elastic pawls are arranged on an outer side of the outer layer; and a gap is formed between the inner layer and the outer layer.

5. The dispensing-by-rotation liquid cosmetic container according to claim 1, wherein a head of the threaded rod is polygonal; the piston is provided with a slot, the slot has an opening facing toward a lower end of the piston, and a shape of the slot is complementary to a shape of the head of the threaded rod; and the head of the threaded rod is fixedly inserted into the slot.

6. The dispensing-by-rotation liquid cosmetic container according to claim 1, wherein an annular ring protruding radially outward is provided on an outer side of a middle of the threaded cylinder, and an annular groove configured to receive the annular ring is provided on an inner side of an upper end of the tail cap.

7. The dispensing-by-rotation liquid cosmetic container according to claim 1, wherein the bristle assembly comprises a bristle base connected to the front end of the receiving space, bristles arranged on the bristle base, and a bristle sleeve sleeved on the bristles; and a channel connected to an inside of the bristles is provided in the bristle base.

8. The dispensing-by-rotation liquid cosmetic container according to claim 1, wherein the pen body is a hollow structure, and each of the front end of the pen body and a rear end of the pen body is provided with an opening; a diameter of the front end of the pen body is smallest in the pen body; and the pen cap is sleeved on and snap-fitted to the front end of the pen body.

* * * * *